US005920298A

United States Patent [19]

McKnight

[11] Patent Number: 5,920,298

[45] Date of Patent: Jul. 6, 1999

[54] DISPLAY SYSTEM HAVING COMMON ELECTRODE MODULATION

[75] Inventor: Douglas McKnight, Boulder, Colo.

[73] Assignee: Colorado MicroDisplay, Inc., Boulder, Colo.

[21] Appl. No.: 08/770,233

[22] Filed: Dec. 19, 1996

[51] Int. Cl.[6] ..... G09G 3/36

[52] U.S. Cl. ..... 345/87; 345/90; 345/100

[58] Field of Search ..... 345/87, 88, 90, 345/94, 95, 98, 100, 151, 89, 208, 92, 147, 148; 445/24; 349/86, 78, 102

[56] References Cited

U.S. PATENT DOCUMENTS

| | | | |
|---|---|---|---|
| H2 | 12/1985 | Soloway | 340/701 |
| H1320 | 6/1994 | Kieronski | 359/48 |
| 3,097,260 | 7/1963 | James | 178/5.4 |
| 3,507,982 | 4/1970 | Sugihara | 178/5.4 |
| 3,651,511 | 3/1972 | Andrews et al. | 340/324 R |
| 3,703,329 | 11/1972 | Castellano | 350/150 |
| 3,938,134 | 2/1976 | Hackstein et al. | 340/324 M |
| 4,082,430 | 4/1978 | Schulthess et al. | 350/333 |
| 4,090,219 | 5/1978 | Ernstoff et al. | 358/59 |
| 4,150,396 | 4/1979 | Hareng et al. | 358/60 |
| 4,240,113 | 12/1980 | Michael et al. | 358/180 |
| 4,315,258 | 2/1982 | McKnight et al. | 340/784 |
| 4,335,393 | 6/1982 | Pearson | 358/4 |
| 4,364,039 | 12/1982 | Penz | 340/784 |
| 4,416,514 | 11/1983 | Plummer | 350/335 |
| 4,432,610 | 2/1984 | Kobayashi et al. | 350/331 R |
| 4,449,123 | 5/1984 | Muranaga | 340/716 |
| 4,451,825 | 5/1984 | Hall et al. | 340/750 |
| 4,464,018 | 8/1984 | Gagnon | 350/331 R |
| 4,487,480 | 12/1984 | Nonomura et al. | 350/335 |
| 4,574,282 | 3/1986 | Crossland et al. | 340/784 |
| 4,635,051 | 1/1987 | Bos | 340/757 |
| 4,652,912 | 3/1987 | Masubuchi | 358/59 |
| 4,709,995 | 12/1987 | Kuribayashi et al. | 350/350 S |
| 4,716,403 | 12/1987 | Morozumi | 340/702 |
| 4,768,092 | 8/1988 | Ishikawa | 358/140 |
| 4,769,639 | 9/1988 | Kawamura et al. | 340/784 |
| 4,770,500 | 9/1988 | Kalmanash et al. | 350/347 E |

(List continued on next page.)

OTHER PUBLICATIONS

Sayyah et al., "Color Sequential Crystalline Silicon LCLV Based Projector for consumer HDTV," Society For Information Display, vol. XXVI pp. 520–523, 1995.

H. Okada, et al., "An 8.4–in. TFT–LCD System for a Note–Size Computer Using 3–Bit Digital Data Drivers," *Japan Display* (1992), pp. 475–478.

*Primary Examiner*—Richard A. Hjerpe
*Assistant Examiner*—Francis N. Nguyen
*Attorney, Agent, or Firm*—Blakely, Sokoloff, Taylor & Zafman

[57] ABSTRACT

An electro-optic display system having cover glass electrode modulation. The display system comprises an electro-optic layer disposed between first and second substrates having a single common electrode and a plurality of pixel electrodes, respectively. Voltage modulation of the common electrode is temporally related to image data acquisition by the pixel electrodes and allows data to be updated to each of the plurality of pixel electrodes simultaneously.

16 Claims, 10 Drawing Sheets

U.S. PATENT DOCUMENTS

| | | | |
|---|---|---|---|
| 4,773,026 | 9/1988 | Takahara et al. | 364/518 |
| 4,808,991 | 2/1989 | Tachiuchi et al. | 340/793 |
| 4,822,142 | 4/1989 | Yasui | 350/332 |
| 4,827,255 | 5/1989 | Ishii | 340/793 |
| 4,838,655 | 6/1989 | Hunahata et al. | 350/335 |
| 4,842,379 | 6/1989 | Oishi et al. | 350/347 |
| 4,843,381 | 6/1989 | Baron | 340/784 |
| 4,855,724 | 8/1989 | Yang | 340/703 |
| 4,864,290 | 9/1989 | Waters | 340/793 |
| 4,864,538 | 9/1989 | Buzak | 365/128 |
| 4,886,343 | 12/1989 | Johnson | 350/335 |
| 4,917,465 | 4/1990 | Conner et al. | 350/335 |
| 4,921,334 | 5/1990 | Akodes | 350/333 |
| 4,950,058 | 8/1990 | Diem et al. | 350/333 |
| 4,980,775 | 12/1990 | Brody | 358/241 |
| 4,982,180 | 1/1991 | Seki et al. | 340/703 |
| 4,989,076 | 1/1991 | Owada et al. | 358/61 |
| 4,991,122 | 2/1991 | Sanders | 364/521 |
| 4,999,619 | 3/1991 | Te Velde | 340/784 |
| 5,012,228 | 4/1991 | Masuda et al. | 340/702 |
| 5,032,007 | 7/1991 | Silverstein et al. | 350/335 |
| 5,039,983 | 8/1991 | Yoon | 340/703 |
| 5,068,649 | 11/1991 | Garrett | 340/793 |
| 5,077,533 | 12/1991 | Buzak | 340/794 |
| 5,093,652 | 3/1992 | Bull et al. | 340/701 |
| 5,101,197 | 3/1992 | Hix et al. | 340/784 |
| 5,105,183 | 4/1992 | Beckman | 340/717 |
| 5,105,265 | 4/1992 | Sato et al. | 358/60 |
| 5,115,305 | 5/1992 | Baur et al. | 358/60 |
| 5,119,084 | 6/1992 | Kawamura et al. | 340/784 |
| 5,122,783 | 6/1992 | Bassetti, Jr. | 340/701 |
| 5,124,818 | 6/1992 | Conner et al. | 359/53 |
| 5,126,865 | 6/1992 | Sarma | 359/59 |
| 5,128,782 | 7/1992 | Wood | 309/48 |
| 5,132,826 | 7/1992 | Johnson et al. | 359/93 |
| 5,172,108 | 12/1992 | Wakabayashi et al. | 340/793 |
| 5,172,222 | 12/1992 | Plantier et al. | 358/61 |
| 5,185,602 | 2/1993 | Basetti, Jr. et al. | 340/793 |
| 5,196,834 | 3/1993 | Edelson et al. | 340/703 |
| 5,200,844 | 4/1993 | Suvada | 359/40 |
| 5,204,659 | 4/1993 | Sarma | 340/784 |
| 5,225,823 | 7/1993 | Kanaly | 340/793 |
| 5,227,882 | 7/1993 | Kato | 358/160 |
| 5,233,338 | 8/1993 | Surguy | 340/784 |
| 5,237,435 | 8/1993 | Kurematsu et al. | 359/41 |
| 5,245,450 | 9/1993 | Ukai et al. | 359/55 |
| 5,252,959 | 10/1993 | Kono | 345/147 |
| 5,264,835 | 11/1993 | Shaw et al. | 345/150 |
| 5,289,173 | 2/1994 | Numao | 345/87 |
| 5,293,534 | 3/1994 | Mihara | 359/84 |
| 5,296,953 | 3/1994 | Kanbe et al. | 359/56 |
| 5,299,039 | 3/1994 | Bohannon | 359/53 |
| 5,313,224 | 5/1994 | Singhal et al. | 345/89 |
| 5,327,229 | 7/1994 | Konno et al. | 348/742 |
| 5,337,068 | 8/1994 | Stewart et al. | 345/88 |
| 5,341,153 | 8/1994 | Benzschawel et al. | 345/152 |
| 5,359,345 | 10/1994 | Hunter | 345/102 |
| 5,363,117 | 11/1994 | Matsuura et al. | 345/87 |
| 5,365,274 | 11/1994 | Seki et al. | 348/458 |
| 5,381,182 | 1/1995 | Miller et al. | 348/448 |
| 5,386,237 | 1/1995 | Knee | 348/458 |
| 5,396,261 | 3/1995 | Hastings, III | 345/92 |
| 5,412,396 | 5/1995 | Nelson | 345/89 |
| 5,418,572 | 5/1995 | Nonweiler et al. | 348/446 |
| 5,424,780 | 6/1995 | Cooper | 348/428 |
| 5,428,366 | 6/1995 | Eichenlaub | 345/102 |
| 5,444,494 | 8/1995 | Yamamoto et al. | 348/448 |
| 5,455,628 | 10/1995 | Bishop | 348/446 |
| 5,457,551 | 10/1995 | Culter et al. | 359/53 |
| 5,459,495 | 10/1995 | Scheffer et al. | 345/147 |
| 5,467,138 | 11/1995 | Gove | 348/452 |
| 5,471,249 | 11/1995 | Monta et al. | 348/445 |
| 5,473,339 | 12/1995 | Kanatani et al. | 345/87 |
| 5,479,188 | 12/1995 | Moriyama | 345/149 |
| 5,488,387 | 1/1996 | Maeda et al. | 345/89 |
| 5,488,389 | 1/1996 | Nakanishi et al. | 345/131 |
| 5,493,428 | 2/1996 | Kim | 359/54 |
| 5,495,265 | 2/1996 | Hartman et al. | 345/87 |
| 5,495,287 | 2/1996 | Kasai et al. | 345/89 |
| 5,499,036 | 3/1996 | Hauck | 345/3 |
| 5,499,037 | 3/1996 | Nakagawa et al. | 345/89 |
| 5,519,824 | 5/1996 | Lizzi | 395/150 |
| 5,521,727 | 5/1996 | Inaba et al. | 359/56 |
| 5,526,063 | 6/1996 | Joubert et al. | 348/744 |
| 5,528,262 | 6/1996 | McDowell et al. | 345/151 |
| 5,534,884 | 7/1996 | Mase et al. | 345/87 |
| 5,534,926 | 7/1996 | Ohki et al. | 348/385 |
| 5,534,936 | 7/1996 | Kim | 348/448 |
| 5,537,128 | 7/1996 | Keene et al. | 345/89 |
| 5,537,129 | 7/1996 | Okada et al. | 345/90 |
| 5,546,102 | 8/1996 | Scheffer et al. | 345/100 |
| 5,552,801 | 9/1996 | Furuhashi et al. | 345/100 |
| 5,552,840 | 9/1996 | Ishii et al. | 348/751 |
| 5,555,035 | 9/1996 | Mead et al. | 348/757 |
| 5,561,442 | 10/1996 | Okada et al. | 345/94 |
| 5,566,010 | 10/1996 | Ishii et al. | 359/59 |
| 5,572,655 | 11/1996 | Tuljapurkar et al. | 395/788 |
| 5,579,027 | 11/1996 | Sakurai et al. | 345/100 |
| 5,581,383 | 12/1996 | Reichel et al. | 349/116 |
| 5,583,534 | 12/1996 | Katakura et al. | 345/97 |
| 5,594,464 | 1/1997 | Tanaka et al. | 345/94 |
| 5,640,259 | 6/1997 | Sawayama et al. | 349/33 |
| 5,642,129 | 6/1997 | Zavracky et al. | 345/100 |
| 5,721,597 | 2/1998 | Kakinuma et al. | 349/86 |

DISPLAY SYSTEM HAVING COMMON ELECTRODE MODULATION

BACKGROUND OF THE INVENTION

1. Field of the Invention

The present invention relates generally to a display system, such as a liquid crystal display system. The present invention also relates to a system for providing electrical driving of a common electrode which is on an unpixellated substrate of a display system. More particularly, the invention relates to a system for electrically driving the common electrode of a display system to various voltages in a controlled phase relationship to the update of pixel data.

2. Background of the Related Art

A class of display systems operate by electrically addressing a thin, intervening layer of electro-optic material, such as liquid crystal, which is positioned between two substrates. In these display systems, it is important to achieve good display characteristics including: color purity, high contrast, high brightness, and a fast response.

High independence of frames or subframes ensures the lack of coupling between intensity values at a given pixel from one frame to the next. For example, if a pixel is to be at its brightest grey level during a first frame and then at its darkest grey level at the next frame, then a high independence would ensure that this is possible whereas a low independence would cause to pixel to appear brighter than the darkest grey level during the second frame. This coupling can cause problems such as motion smearing. High frame-to-frame independence is important whether or not the display is a color or black-and-white display.

The level of contrast achievable is determined by the range of intensity attainable between the brightest grey level and the darkest grey level for a given pixel within a given frame or subframe.

In addition to contrast, it is desirable that the display be capable of displaying a bright image since the brighter image can be viewed without the necessity of external light sources or strong ambient light.

Finally, the speed of display is determined its ability to display one frame after the other at a high rate. If visual motion is to be displayed, flicker and other problems can be avoided only if the full color frames are displayed at a rate of least 30 Hz.

This speed requirement becomes even more stringent if the display does not contain a red, green, and blue pixel all at one pixel location but instead only has a single pixel. One type of such a display is a color sequential liquid crystal display as discussed in "Color-Sequential Crystalline-Silicon LCLV based Projector for Consumer HDTV" by Sayyah, Forber, and Efrom in SID digest (1995) pages 520–523. In those type of displays, if a display requires the sequential display of the red, green, and blue subframes, those subframes must be displayed at yet a higher rate than 30 Hz and preferably greater than 90 Hz to avoid flicker. For color sequential displays, high frame or subframe independence is required to display images with good color purity.

Any of the general display systems that operate by electrically addressing a thin, intervening layer of electro-optic material, such as liquid crystal, which is positioned between two substrates include the following characteristics. At least one of the two substrates is transparent or translucent to light and one of the substrates includes a plurality of pixel electrodes. Each pixel electrode corresponds to one pixel of the display, and each of the former may be driven independently to certain voltages so as to control the intervening electro-optic layer in such a way as to cause an image to be displayed on the electro-optic layer of the display. Sometimes each pixel can include color triad of pixel electrodes. The second substrate of such a prior art display system has a single electrode, known as the common electrode, which serves to provide a reference voltage so that the pixel electrodes can develop an electric field across the intervening layer of electro-optic material.

One example of such a system is a color thin film transistor (TFT) liquid crystal display. These displays are used in many notebook-sized portable computers. Colors are generated in these displays by using RGB pixel triads in which each pixel of the triad controls the amount of light passing through its corresponding red, green, or blue color filter. These color filters are one of the most costly components of a TFT display.

The major obstacle of display systems of this type is that the results of replicating the pixel electrodes, data wire, and thin film transistors, three times at each color pixel are increased cost and reduced light transmission, requiring more peripheral backlights and increased power consumption.

The other issues of high frame-to-frame independence, high contrast, and brightness become even more difficult to achieve as display rates increase.

Many approaches have been implemented to improve display characteristics of the above type displays. One common approach involves the use of a common electrode driving circuit and driving that common electrode with as flat a common electrode rectangular driving voltage as possible. By doing so, the voltage across the liquid crystal portion at that pixel is more constant, which in turn should yield improved contrast and pixel brightness.

For example, U.S. Pat. No. 5,537,129 discloses a display system with a common electrode which attempts to achieve a flat rectangular common electrode driving voltage. Referring to FIG. 2 of that patent, a common electrode 24 is connected to its driving circuit 20 through a resistor 3*b*. This corrects for resistive losses at 3*a* and capacitive coupling to the common electrode 24 from pixels and data wires. This ensures that detection device 21 with a high input impedance can be used to make a correction so the output voltage appears to be more rectangular-like. FIGS. 5, 9*b*, 11(*c*), and 11(*d*) of that reference all show the desired rectangular waveforms.

Another example of this is shown with U.S. Pat. No. 5,561,442. Referring to Figure which shows that with the properly applied common electrode voltage Vc(t) when coordinated with the previous gate wire voltage Vs(t) and the current gate wire voltage Vg(t), can yield a flat rectangular voltage V(t)–Vc(t) across the liquid crystal ($C_{LC}$). This scheme involves a complicated modulation scheme coordinating modulation voltages at gate wires in relation to the modulation of the voltage at the common electrode in order to achieve their desired flat rectangular modulation of voltage across the liquid crystal.

SUMMARY OF THE INVENTION

Accordingly, one object of the present invention is to provide a method for electrically driving the common electrode of an electro-optic display system in which the pixel electrodes are simultaneously updated with new data.

Another object of the invention is to provide an electro-optic display system in which high frame-to-frame independence is achieved, even at high rates of display.

Another object of the invention is to provide an electro-optic display system in which high image contrast and brightness are achieved even at high rates of display.

Another object of the invention is to provide an electro-optic display system in which common electrode voltage modulation is temporally related to image data acquisition by the pixel electrodes.

Another object of the invention is to provide an electro-optic display system in which common electrode voltage modulation is temporally related to image data acquisition by the pixel electrodes and wherein the common electrode voltage is switched between two voltage levels.

Another object of the invention is to provide an electro-optic display system which has frame independence and/or subframe independence by rapid drive-to-dark of a group of pixels.

Another object of the invention is to provide an electro-optic display system in which common electrode voltage modulation is temporally related to image data acquisition by the pixel electrodes, wherein the common electrode voltage is predominantly switched between two voltage levels, but has an additional pulse superimposed thereon.

One advantage of the present invention is that the common electrode of the display system is driven to different voltages in a controlled phase relationship to pixel data acquisition. This advantage is useful in systems which require synchronization of the image data with external components, such as a color sequential illuminator in a color sequential display system or a flashing laser in a beam-steering application.

Another advantage of the invention is that by simultaneously varying the voltage which drives the common electrode and the voltages which drive the pixels, a larger RMS voltage difference can be achieved across the intervening layer of electro-optic material, thereby achieving improved brightness.

A further advantage of the current invention is that the common electrode can be driven, in one embodiment of the invention, to a voltage greater than the maximum and minimum voltages allowed for driving the pixel electrodes. By driving the common electrode voltage beyond the pixel maximum and minimum voltage, a larger voltage difference can be achieved across the intervening layer of electro-optic material. This advantage is useful in a situation where the liquid crystal electro-optic effect has a threshold below which no optical effect occurs.

Another advantage of the claimed invention, is that in a further embodiment the common-electrode voltage is modulated with a pulse which improves the behavior of the electro-optic layer. This improvement aids rapid switching between gray levels.

Another advantage, according to a further embodiment of the invention, is that if the common-electrode voltage is modulated with a burst of relatively high frequency oscillation, a dual frequency liquid crystal display can be driven rapidly.

Another advantage, according to a further embodiment of the invention, is that if the common-electrode voltage is modulated to achieve a rapid drive-to-dark of the liquid crystal, gray levels are subsequently established by allowing the liquid crystal to relax to different levels depending on the voltage on the pixel electrode. This improvement allows independence between subsequent frames because there is a complete reset of the material between each frame.

One feature of the invention is that common electrode voltage modulation can comprise pulses of shorter duration than that of image data on the pixels.

Another feature of the invention is that common electrode voltage modulation can comprise pulses of longer duration than that of image data on the pixels.

Another feature of the invention is that common electrode voltage modulation can comprise bursts of relatively high frequency AC modulation.

Another feature of the invention is that common electrode voltage modulation can comprise one burst of relatively high frequency ac modulation for each update of the image data to the pixel electrodes.

Another feature of the invention is that common electrode voltage modulation can comprise a pulse to achieve a rapid drive-to-dark of the liquid crystal.

Another feature of the invention is that common electrode voltage modulation can be used to achieve simultaneous drive-to-dark of groups of pixels which do not have simultaneous update of their electrode voltage.

Another feature of the invention is that common electrode voltage modulation can be used to achieve a simultaneous transition to a new gray level of groups of pixels which do not have simultaneous update of their electrode voltage.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements, wherein.

DETAILED DESCRIPTION OF PREFERRED EMBODIMENTS

The preferred embodiments of a display system which allows data to be acquired by, or updated to, all pixels in a simultaneous or quasi-simultaneous manner, according to the present invention, will now be described with reference to the accompanying drawings.

Figure 1A:
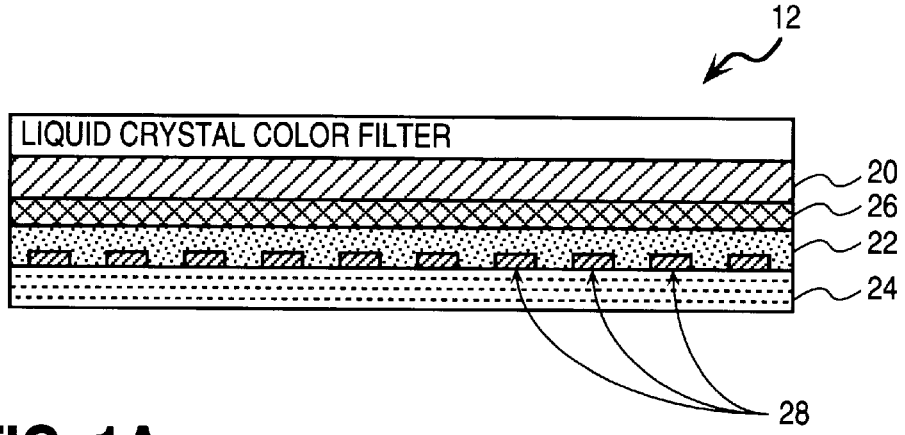
FIG. 1A shows a cross-sectional view.
Figure 1B:
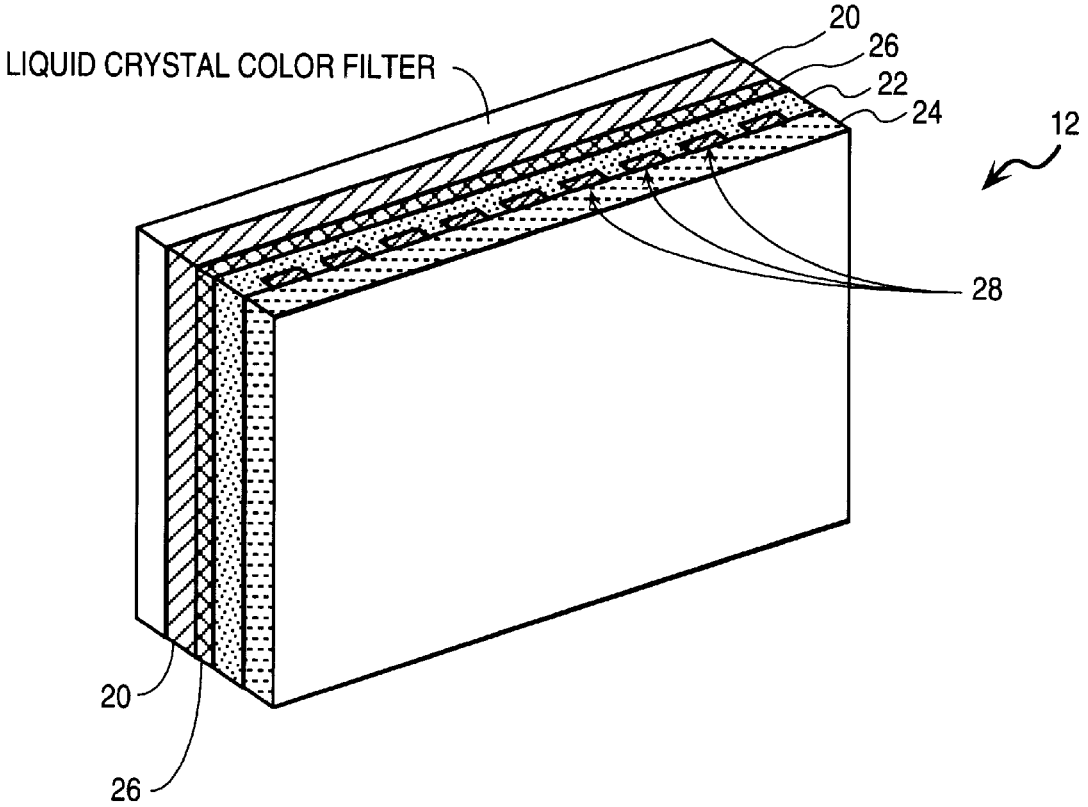
FIG. 1B shows a perspective view, of an image display system according to one embodiment of the invention.

FIG. 1A shows a cross-sectional view of a display system 12 according to one embodiment of the invention, in which an electro-optic layer 22 is disposed between a first substrate 20 and a second substrate 24. First substrate has a single electrode known as a common electrode 26. Second substrate 24 has a plurality of pixel electrodes 28, each of which periodically acquires updated image data in an independent manner. Each pixel electrode 28 retains the image data acquired for a given period of time or duration, after which the acquired image data is replaced with new image data. At least one of first substrate 20 and second substrate 24 is transparent or translucent to light. According to one embodiment of the invention, electro-optic layer 22 may comprise liquid crystal material, and display system 12 may comprise a liquid crystal display. FIG. 1B shows a perspective view of the same display system as shown in FIG. 1A.

Some liquid crystal display systems utilize a frame sequential DC balancing scheme in which the liquid crystal is DC balanced by writing data such that the sequence of images is alternately written of positive and then negative polarity. Given that any pixel electrode of the display substrate can be driven to a voltage in the range between $V_{max}$ and $V_{min}$, if the common electrode is fixed at a voltage half way between $V_{max}$ and $V_{min}$, then the maximum DC balanced signal that can be applied to the liquid crystal alternates between $+(V_{max}-V_{min})/2$ and $-(V_{max}-V_{min})/2$ in sequential frames, resulting in an RMS voltage of $(V_{max}-V_{min})/2$.

Figure 2:
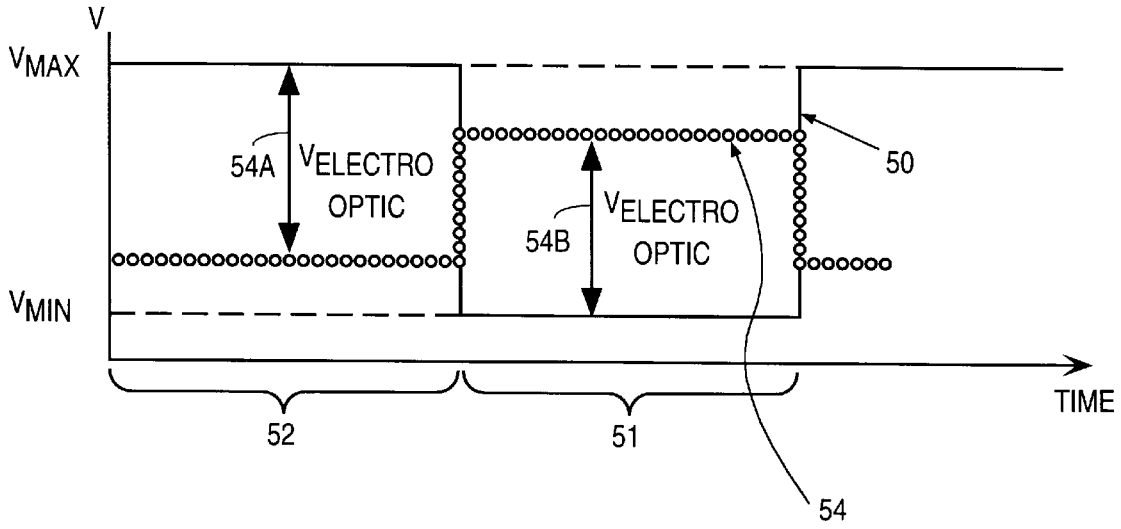
FIG. 2 is a schematic representation of common electrode voltage modulation between $V_{max}$ and $V_{min}$ in an image display system according to one embodiment of the invention.

Several different forms of common electrode voltage modulation may be performed according to various embodiments of the present invention. With reference to FIG. 2, according to a first embodiment of the invention, voltage 50 of common electrode 26 of display system 12 may be modulated between $V_{max}$ and $V_{min}$. By driving common electrode 26 to $V_{min}$ during the "positive" frame 51 of such an electrical addressing scheme and to $V_{max}$ during the "negative" frame 52, the voltage of the maximum DC balanced RMS signal appearing across the electro-optic layer is doubled from $(V_{max}-V_{min})2$ to $V_{max}-V_{min}$ (RMS)

For example, during the "positive" frame, a pixel which is to be driven to a bright state is assumed to require a high voltage at the pixel electrode. (Note, however, that the opposite situation could also hold true, i.e. a high voltage of common electrode 26 could drive a pixel to the dark state, depending on the configuration of electro-optic layer or liquid crystal used.) According to the present invention, the common electrode may be driven to $V_{min}$ during the "positive" frame. Therefore, the voltage that can be presented across electro-optic layer 22 ranges from $V_{min}-V_{min}$ to $V_{max}-V_{min}$, and is identical to the voltage range available at a pixel electrode 28.

In the "negative" frame the common electrode is driven to $V_{max}$, and a bright state is achieved by driving the pixel electrode to a low voltage so as to maximize the voltage across electro-optic layer 22. In this case the voltage that can be presented across electro-optic layer 22 ranges from $V_{max}-V_{max}$ to $V_{min}-V_{max}$. In the example shown in FIG. 2 the pixel electrode is driven so that the voltage 54 across the electro-optic is about ⅔ of the maximum available voltage (for both voltages 54A and 54B).

One subclass of display systems allows the pixel electrodes to be simultaneously updated with data corresponding to a new image. Such display systems are described in U.S. patent application Ser. No. 08/505,654, the contents of which are incorporated herein by reference and will be referred to as frame (subframe) sequential display devices. Since the pixels are simultaneously updated for this type of display, the pixel electrodes do not have to be driven to voltages other than their data voltages (and their inverses for dc balance) when the common electrode is modulated, which simplifies the drive circuitry, according to one embodiment of the invention.

This is different from for a row-at-a-time update of the pixel electrodes. One way this can be done in active matrix displays is to drive the reference plates of the pixel data storage capacitors through a voltage sequence which mimics the common electrode voltage modulation. This could be done by driving all the row gate wires synchronously with the common electrode, at the cost of increased complexity and power dissipation. See for example U.S. Pat. No. 5,561,422 and an article from Japan Display, entitled " ", 1992 pages 475–478, the contents of which are incorporated herein by reference.

Figure 3:
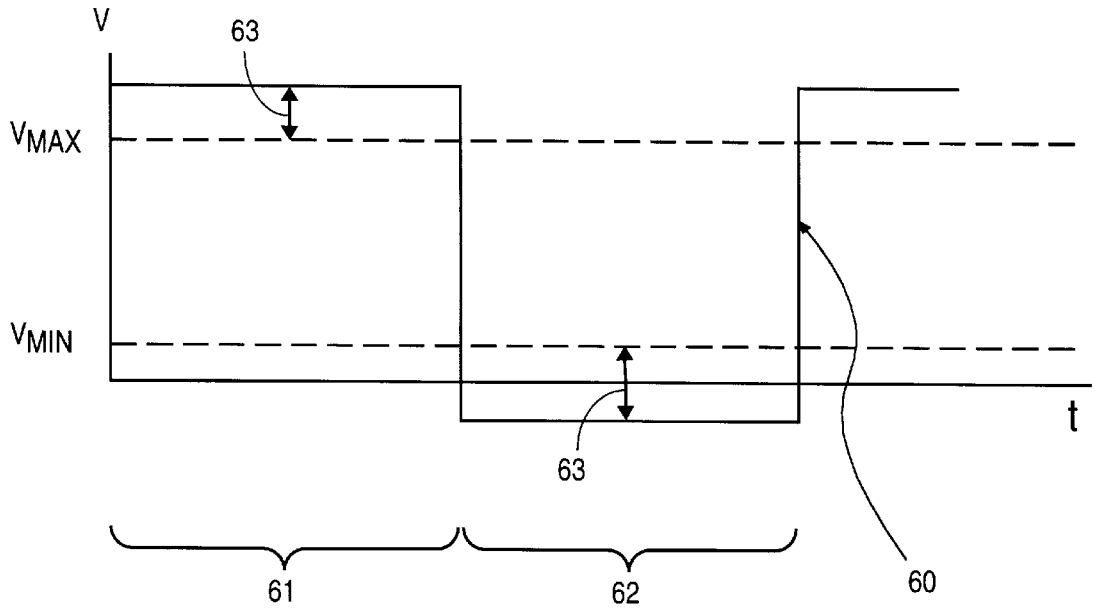
FIG. 3 is a schematic representation of common electrode voltage modulation in which the common electrode is driven to voltages other than $V_{max}$ and $V_{min}$ in an image display system according to another embodiment of the invention.

According to a second embodiment of the invention common electrode 26 is driven to voltages 60 other than $V_{min}$ and $V_{max}$ in the phase relationship described above. For example, as shown in FIG. 3, common electrode 26 could be driven to a voltage less than $V_{min}$ (e.g. to $V_{min}-V_{offset}$) during the "positive" frame 62, and to a voltage greater than $V_{max}$ (e.g. to $V_{max}+V_{offset}$) during the "negative" frame 61. The result of such a scheme is that the voltage range that can be applied to electro-optic layer 22 is now shifted to $V_{offset}$ 63 as the minimum addressing voltage, and to $V_{offset}+(V_{max}-V_{min})$ as the maximum addressing voltage.

The embodiment of the present invention exemplified by the schematic representation of FIG. 3 could find applications in situations where, for example, the liquid crystal electro-optic effect has a minimum threshold voltage level below which no optical effect occurs. By choosing $V_{offset}$ in such a way as to take up some, or all, of this offset the full range of voltage available at the pixel electrode is available for electro-optic modulation.

Refer again to the above discussed subclass of display systems which allow the pixel electrodes to be simultaneously updated with data corresponding to a new image. One way in which such systems can be operated is to display color images by displaying a sequence of different single-color images in a sequence such as red, then green, then blue, at a rapid enough rate for the human visual system to merge the different colors together and give the viewer the perception of a true color image. Such systems are termed time-sequential color systems and the individual single color images are termed color sub-frames.

According to a third embodiment of the invention the common electrode voltage for the above type display is modulated with a signal that is something other than a rectangular wave-form. For example, an additional voltage pulse may be added to, or superimposed upon, the common electrode modulation voltage in order to improve the behavior of the electro-optic layer. Thus, a display system featuring such a scheme may have the advantage of enhanced rapid switching between gray levels. The shape of an additional or superimposed voltage pulse may be rectangular or non-rectangular.

Figure 4A:
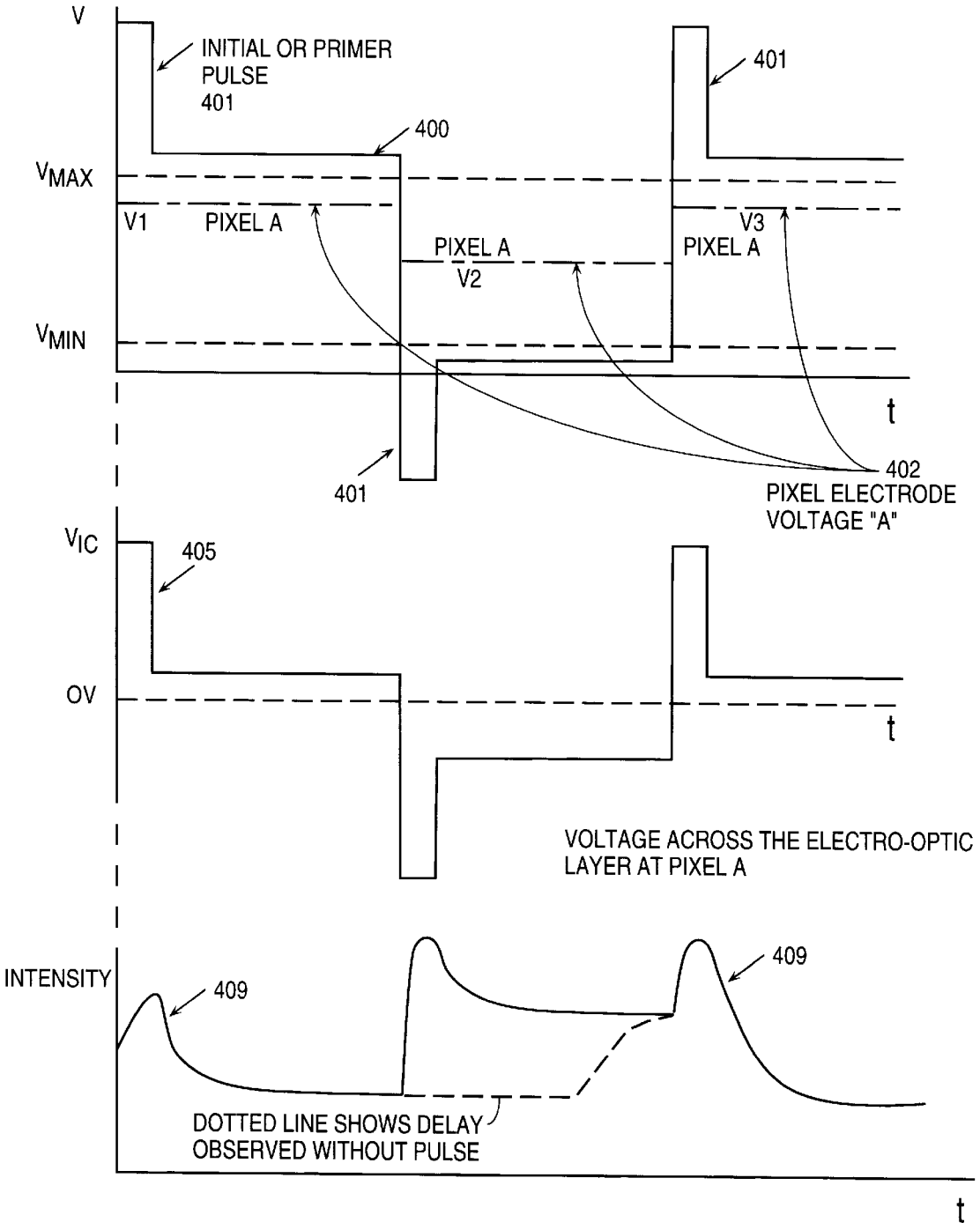
FIG. 4A shows the effects of modulating the common electrode voltage modulation with a signal that is not a rectangular wave-form, according to another embodiment of the invention in which the upper panel shows common electrode voltage and pixel electrode voltage with respect to time when a primer pulse is applied, the middle panel shows voltage across the electro-optic layer for such modulation of the common electrode, and the lower panel shows the intensity output from pixel "A" using the primer pulse (solid line) and without the primer pulse (dashed line).

FIG. 4A shows an example of a liquid crystal pixel switching between gray levels. FIG. 4A depicts the optical response from a single pixel (pixel A) switching between gray levels over three frame periods. In this example, the liquid crystal is driven towards a bright state by increasing voltage, and dc balance is effected on a frame by frame basis. It shows the effects of modulating the common electrode voltage 400 modulation with a signal that is not a rectangular wave-form, according to another embodiment of the invention.

Referring to FIG. 4A, the upper section shows the voltages at the common electrode 400 and the pixel electrode voltage 402 with respect to time when a primer pulse 401 is applied. The middle section shows voltage 405 across the electro-optic layer for such modulation of the common electrode, and the lower section shows the intensity output 409 from pixel A with primer pulse 401 (solid line) and without primer pulse 401 (dashed line). Primer pulse 401 need not be limited to a flat pulse, it can be positive or negative with respect to ground and can even alternate positive and negative.

The amplitude and duration of primer pulse 401 at the beginning of a frame period are chosen such that the primer pulse momentarily drives the liquid crystal beyond the target gray level. For a sequential display as described above, the duration of primer pulse can be from a fraction of a ms to over 1 ms and the amplitude can be any value that yields a primer pulse 405 with a voltage level Vlc at the liquid crystal (electro-optic) layer of the display which is sufficiently large to produce an intensity surge 409 at pixel A. Since primer pulse 401 is applied to all pixels which share the common electrode, it results in an increased switching time between one gray level and a lower gray level. It has the advantage that the time switching between one gray level and a slightly increased gray level is not limited by the observed delay, and slow response in such situation (this is indicated by the dotted line in FIG. 4A). Indeed the upper limit for the time taken for any transition is now bounded by the relaxation time after the initial pulse.

One consequence of the primer pulse is that, depending on its polarity, the voltage across the electro-optic layer may be momentarily, e.g., transiently, increased or decreased immediately following that primer pulse. In one embodiment, the additional or superimposed pulse may be temporally close to the update or acquisition of image data on the pixel electrodes.

Figure 4B:
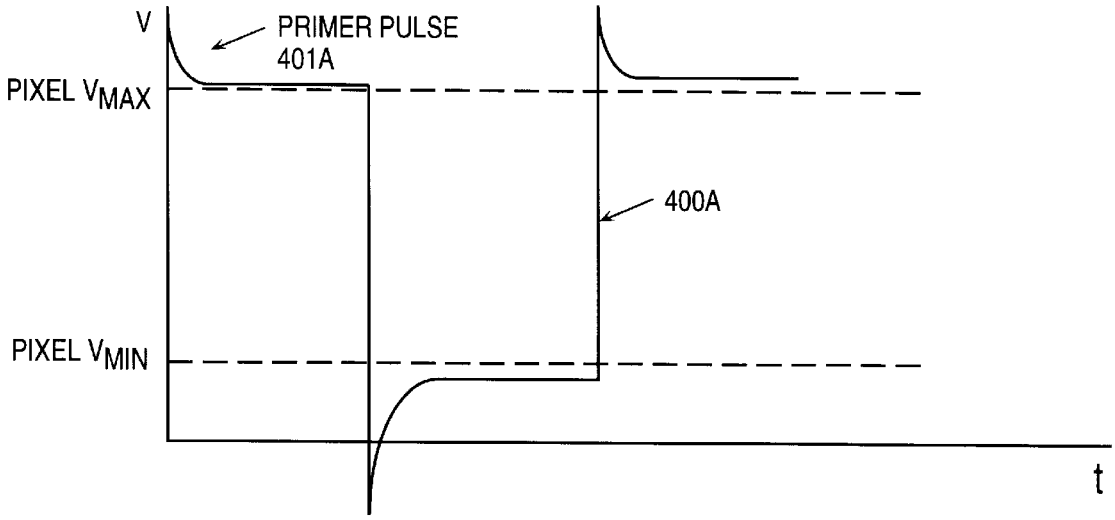
FIG. 4B shows the effects of modulating the common electrode with a voltage that is not a rectangular wave-form and which differs from the signal of FIG. 4A, according to another embodiment of the invention.

FIG. 4B shows another approach to modulating the common electrode for a sequential display device using a primer pulse with a voltage that peaks with an exponential type decay. Primer pulse In FIG. 4A the signal was a small flat pulse added to a common-electrode voltage as shown in FIGS. 2 or 3, for example; while in the case of FIG. 4B the primer pulse 401A is peaking with an exponential-type decay to a steady state value. The additional voltage pulse may, for example, be added near the time at which all the pixel electrodes are updated.

FIGS. 4A and 4B are merely provided as two examples of non-rectangular common electrode voltages 400 and 400A and are not to be construed as limiting the present invention.

Figure 5A:
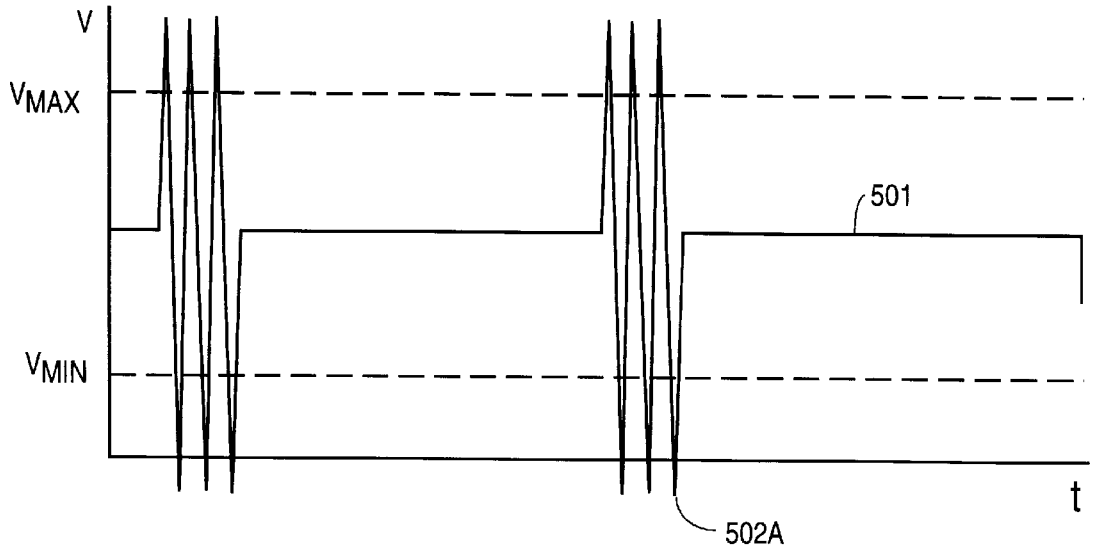
FIGS. 5A and 5B are schematic representations showing a common electrode voltage which is modulated with a burst of relatively high frequency oscillation.
Figure 5B:
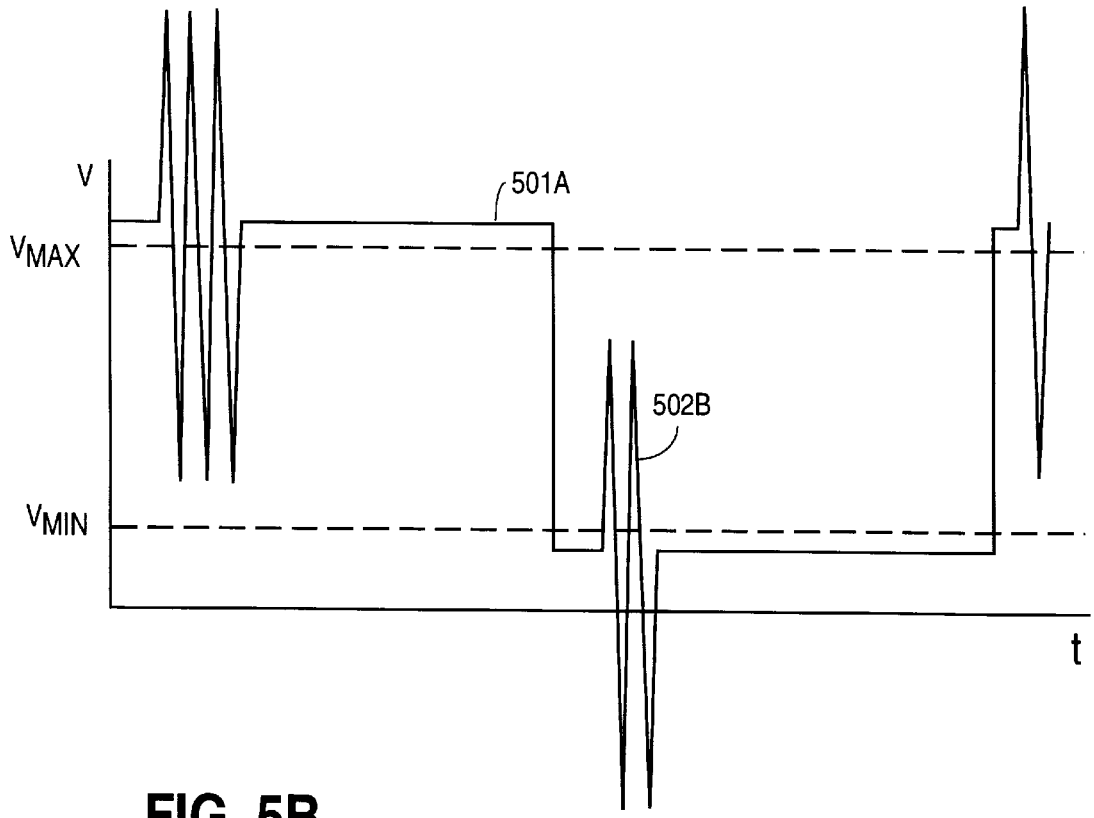

Referring to FIGS. 5A and 5B, according to a fourth embodiment of the invention, the common electrode voltage 501 or 501Ais modulated with a burst of a relatively high-frequency oscillation 502 or 502B (5 KHz to 100 KHz). Such a scheme would be useful for driving dual-frequency liquid crystal materials in these types of displays where below the cross-over frequency the liquid crystal material has a positive dielectric anisotropy, and above the cross-over frequency it has a negative dielectric anisotropy.

As an example of the usefulness of a display system featuring such a scheme, consider the following scenario. An image is written to display system 12 by applying a pattern of voltage to the array of pixel electrodes 28. Common electrode 26 is modulated according to an embodiment of the invention as described above (or, alternatively, may be clamped at a given voltage) while each pixel of electro-optic layer 22 switches to the desired state. Then, after the image has been viewed, it is desired to rapidly reset each pixel of electro-optic layer 22 to an "off" state in preparation for acquisition of the next set of image data. This can be achieved by using a dual-frequency electro-optic liquid crystal material and performing this reset, or "drive-to-off", function by applying a short period of high-frequency drive to common electrode 26.

Within the basic scheme for common electrode modulation, in which the common electrode voltage has a close temporal relationship with the update of image data to the pixel electrodes, there exists a number of variations concerning the nature of the modulation. For example, in one embodiment of the invention, relatively short pulses may be applied to an otherwise DC common electrode voltage. Here, the modulation may consist of pulses of shorter duration than that of image data on the pixels. In another embodiment of common electrode voltage modulation according to the present invention, the pulse duration applied to the common electrode may be of longer duration than that of image data on the pixels. In this latter case, the time period during which image data remains on the pixels is shorter than the refresh period.

According to another embodiment of the invention, the common electrode voltage modulation may comprise bursts of relatively high frequency alternating current (AC) modulation. In another embodiment, the common electrode voltage modulation may comprise one burst of relatively high frequency modulation for each update of image data to the pixel electrodes.

Figure 6A:
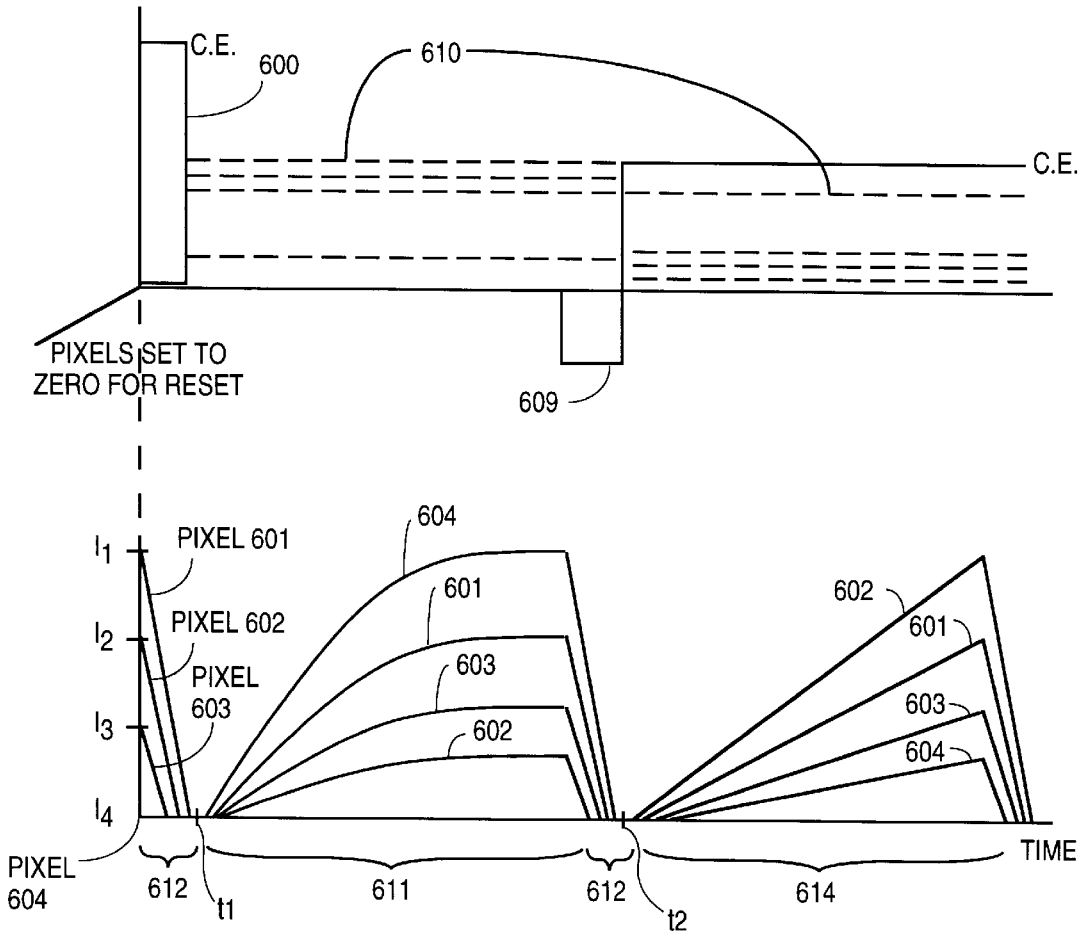
FIG. 6A is a schematic representation of a common electrode voltage which is modulated with a pulse to achieve a rapid drive-to-dark of the electro-optic material.

As shown in FIG. 6A, according to a further embodiment of the present invention, the common-electrode voltage can be modulated with a pulse to achieve a rapid drive-to-dark of the electro-optic material or liquid crystal. Certain liquid crystal cell configurations can be constructed which are normally white, and require addressing by a voltage to drive the cell to a dark state. According to this embodiment, this voltage addressing can be done by driving the common electrode to a voltage sufficiently different from the pixel voltage to achieve a rapid drive-to-dark 612. Gray levels are subsequently established by allowing the liquid crystal to relax back and generate different grey levels 611 depending on the voltage on the pixel electrodes 610.

The common electrode voltage can be overdriven 201 to get the electro-optic material very quickly to a dark state by using a voltage greater than the voltage required to hold a dark state.

Figure 7:
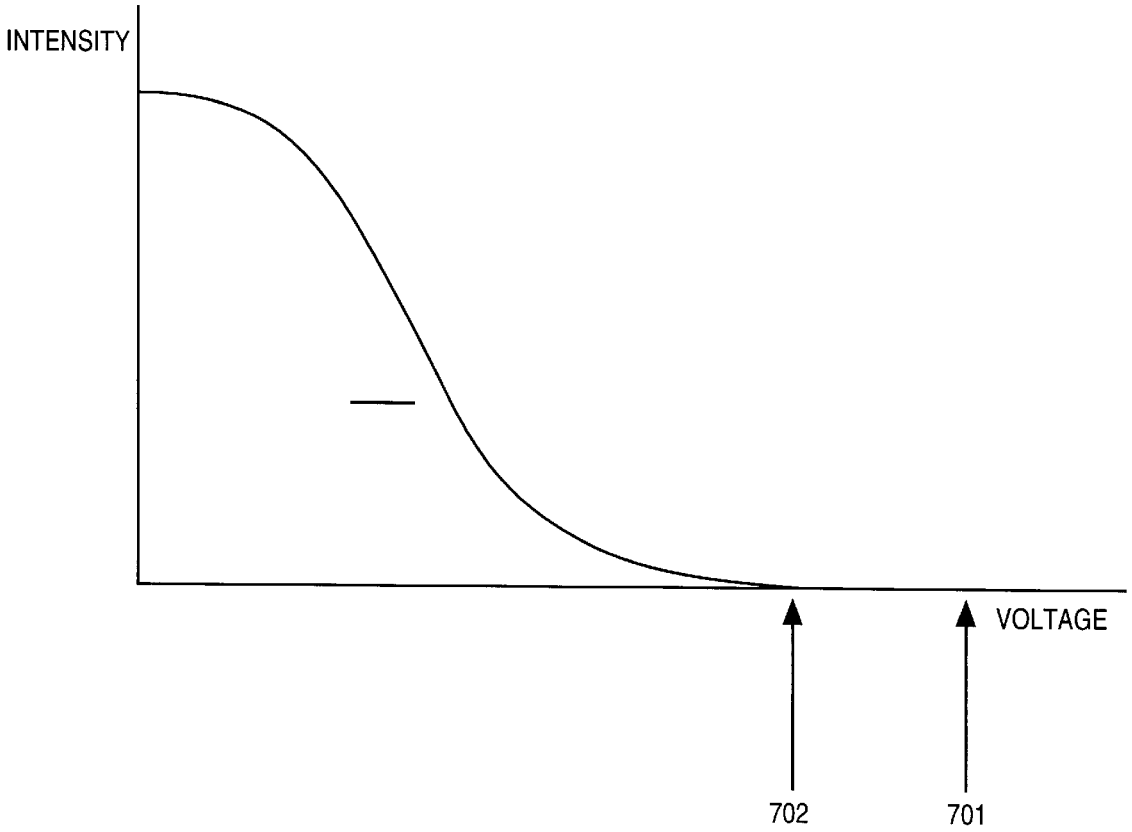
FIG. 7 is a graph showing the relationship between pixel intensity and applied voltage in which the relative voltage values corresponding to dark holding voltage and overdrive-to-dark voltage are indicated.

An example of an electro-optic response which would be suitable for this embodiment is shown in FIG. 7. The intensity output from a pixel decreases with the voltage applied across the electro-optic layer. The electro-optic curve shown here has a saturation response as the voltage is increased above the "black holding voltage 702" that is, the output remains dark for higher voltages.

The relaxation to the gray scales happens through a related family of curves which, even if the material slows down through temperature decrease, will still allow the viewing of gray levels.

Subsequent images are independent of each other since there is a complete reset of the electro-optic material between each image.

A longer viewing time can be achieved in systems which employ time sequential color illumination or time sequential color filtration because as the reset cycle makes color subframes independent of each other the device can be viewed even as the material approaches the gray level from the dark state. It may also be useful to view the pixels even during the rapid reset phase to gain more light throughput. A color sequential scheme is shown in FIG. 6B.

Figure 6B:
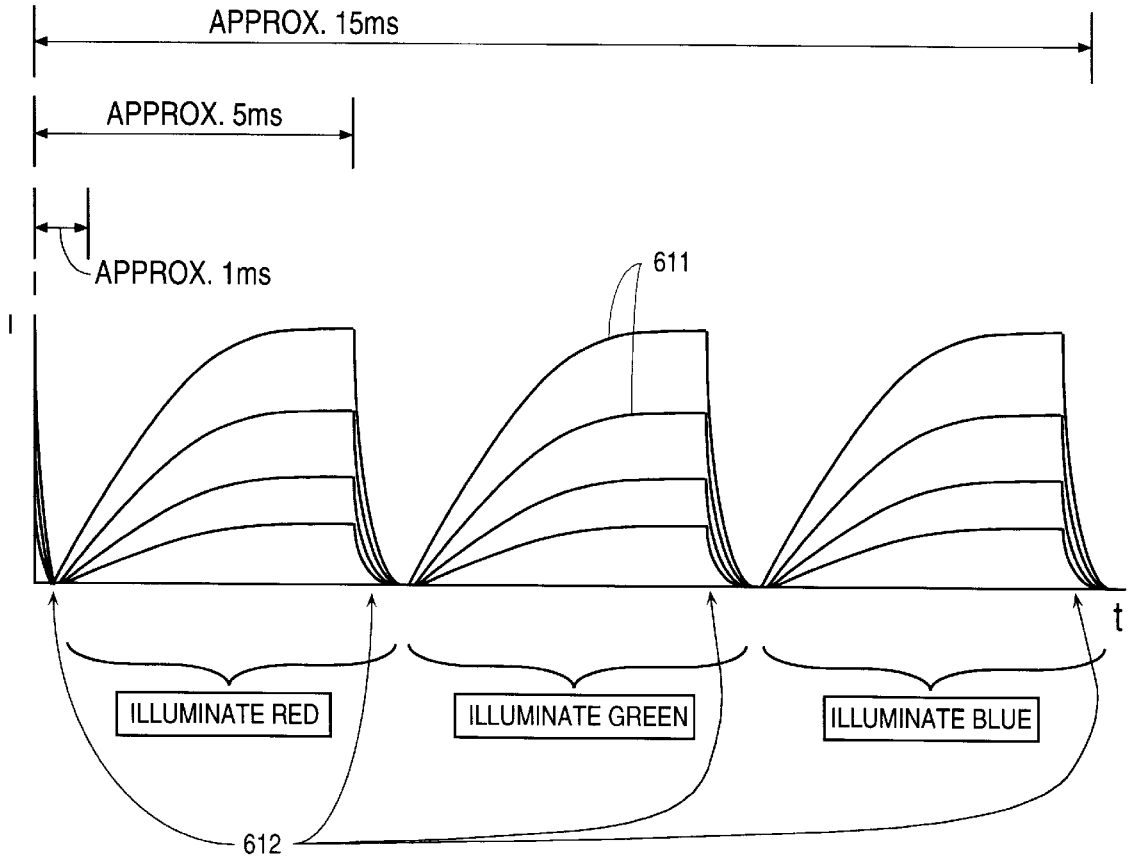
FIG. 6B shows the rapid drive-to-dark after each color subframe.

In particular, FIG. 6B shows the rapid drive-to-dark 612 after each color subframe. Each color subframe can have approximately a 5 ms duration and a red, green and blue subframe can be sequentially displayed within approximately 15 ms. These time periods are merely examples of durations that can achieve visual integration according to U.S. patent application Ser. Nos. 08/505,654 and 08/605,999, the contents of which are incorporated herein by reference. It should be understood, however, that other durations could achieve this including subframe display durations less than 5 ms and even durations of 10 ms or more.

Referring to FIGS. 6A and 6B, a reset pulse 600 is applied to the pixel electrode for a small portion (here 1 ms) of the subframe duration (here 5 ms). Assume there are four pixels 601, 602, 603, and 604 with respective initial intensities of I1, I2, I3, I4 and with respective intensities of 1–4. Once reset pulse 600 is presented to pixels 601–604, their intensities 1–4 drop from I1–I4 to zero, respectively, i.e., they undergo a rapid drive-to-dark 612 at time t1. The intensities 1–4 then increase to their respective grey levels 611. As depicted, pixel 604 is driven to the brightest grey level. The brightness of each pixel as it appears to an observer should be proportional to the area under each curve 1–4. A following reset pulse 609 then drives pixels 601–604 to dark 612 at t2. The following relaxation to grey levels 614 is shown with slower intensity versus time transitions as might occur when pixels 601–604 are cold. As can be seen, frame (or subframe) independence is achieved for pixels 601–604 even if the pixels are cool.

Liquid crystal configurations can be considered which would not normally be suitable for some applications. For example, a thick cell may be easier to manufacture but will be likely to have a response which is too slow.By overdriving to get a fast reset-to-dark, and then viewing gray-scales as the cell relaxes, good performance can be achieved even if the cell never reaches its final state for that addressing voltage. The reset makes this viable because of frame independence.

This embodiment can be made to work with different types of DC balancing. Frame based, column based, row based or even pixel-by-pixel DC balancing can be implemented simply by clamping the common electrode at (Vmax−Vmin)/2 and ensuring that subsequent drive-to-dark pulses are of alternate polarity. In that case, the liquid crystal is DC balanced by controlling only the data driven to the pixel electrodes.

Frame inversion DC balancing can also be implemented in a scheme which modulates the common electrode voltage. An example of this is shown in FIGS. 6A and 6B. In general, DC balance can be maintained with this drive-to-dark scheme by ensuring that the pixel electrode data updates and the drive-to-dark pulse sequence are arranged so that over a number of update cycles, the voltage across the electro-optic layer averages to a value close to zero.

The pixel electrodes can either be clamped at some known voltage during the reset period or they can be left in some arbitrary state if the common-electrode drive is sufficiently high voltage.

As shown in FIG. 6A and 6B, an initial reset can be applied with all pixels set to zero volts. The electro-optic device, e.g., a liquid crystal device, has all pixels go rapidly to dark. The pixels are then all set to their gray level voltages and the liquid crystal display begins to relax to the gray level corresponding to those voltages. The device can be viewed through this entire relaxation (and also through the next reset) because this image is not contaminated with the previous one. The next reset is shown with the pixels set to their highest voltage and the common electrode driven negative. The next image is shown with the common electrode set at the maximum pixel voltage and pixel electrodes below that. Hence, in this particular example DC balance is achieved on a frame by frame basis.

It is important to note in this embodiment of the present invention it is possible to achieve essentially simultaneous drive-to-dark in the optical output of a large group of pixels, such as an image even if the pixels do not have the facility to perform a simultaneous update of their electrodes with new data. Furthermore, it is possible to make pixels appear to have the facility for simultaneous electrode voltage update by using the present invention.

Figure 8A:
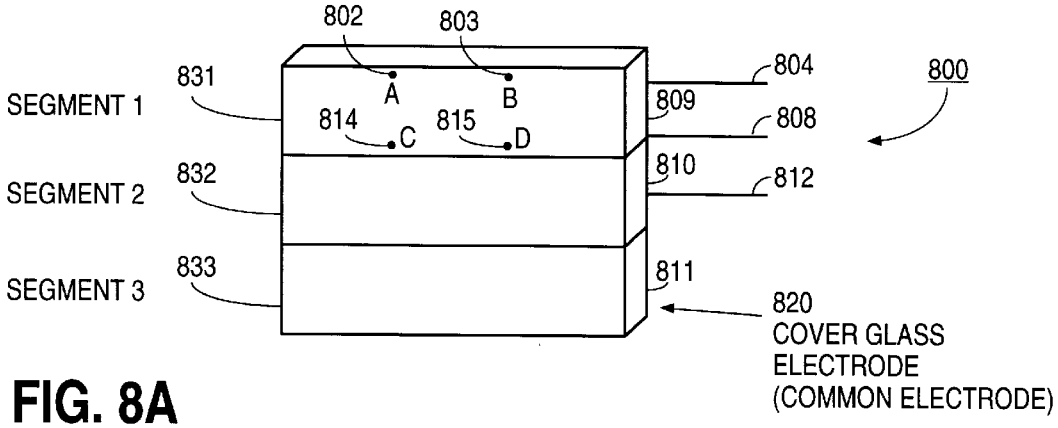
FIG. 8A is a schematic representation of a display with a segmented common electrode according to another embodiment of the invention.

FIG. 8A shows a segmented display 800 made of an array of pixels which in this case have their electrode voltages updated row-at-a-time. Pixels 802 and 803 marked "A" and "B" are on a first row 804 of a segment 809 of array 812 and the pixels 814 and 815 marked "C" and "D" are on the last row 806 of segment 809. Second and third segments 810 and 811 of array 812 are also shown. It should be understood that any segmentation of array 812 can be made and that resulting segments can have only a few pixels or a larger number of pixels and that these pixels can be in one or more rows. Whatever the segmentation of array 812, common electrode 820 is segmented accordingly. Here, for example, common electrode segments 831, 832, and 833 are arranged to correspond to first, second, and third segments 809, 810, and 811 of display array 812.

Figure 8B:
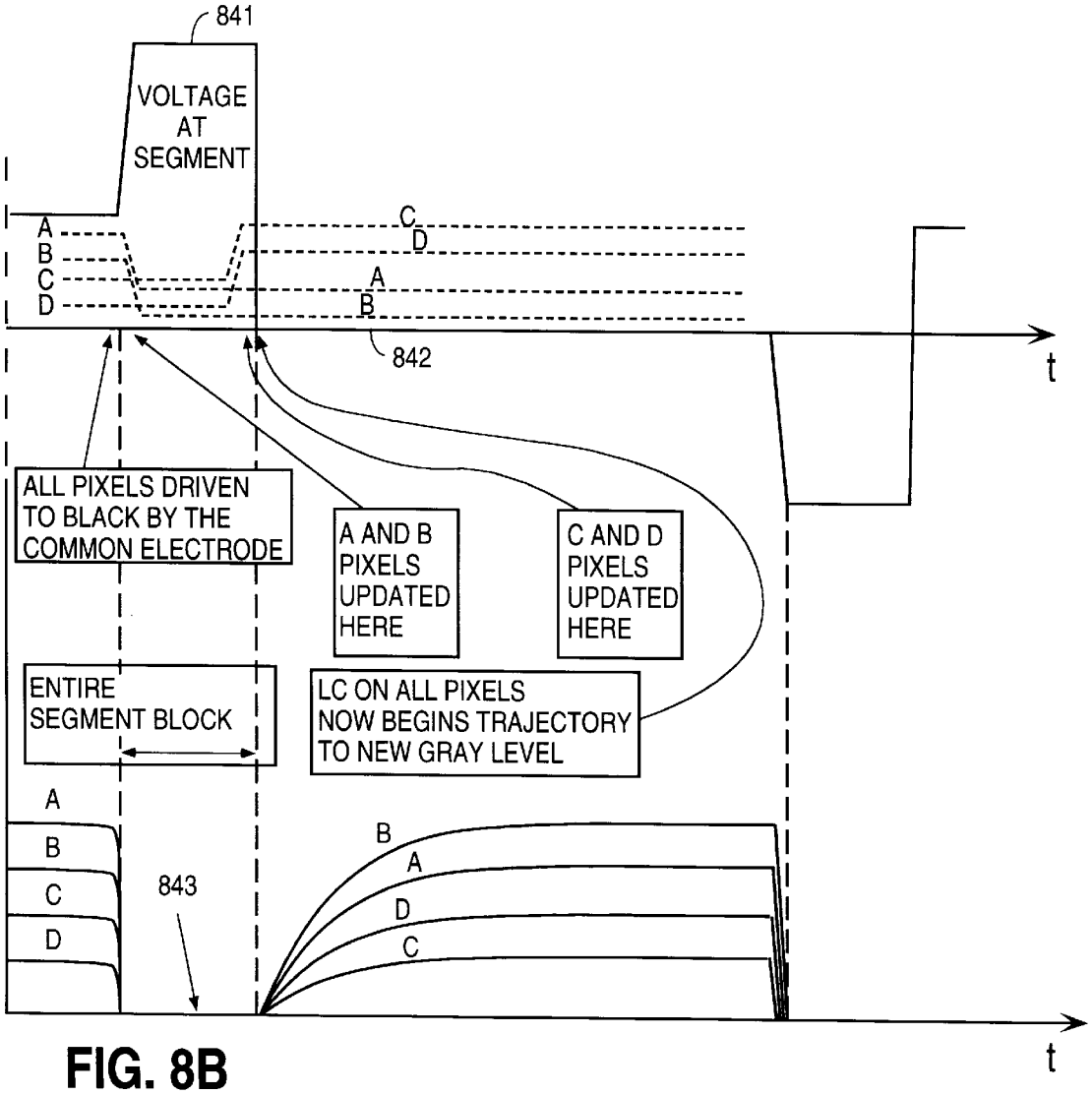
FIG. 8B is a representation of a method of driving pixels so as to simultaneously drive a group of pixels to dark, to allow them to simultaneously update the pixels to a new grey level, even if the pixel electrodes are not updated simultaneously.

FIG. 8B shows a possible addressing sequence according to one embodiment of the invention. The sequence begins with pixels "A", "B", "C", and "D" all having electrode voltages corresponding to an image which has been viewed and is about to be updated. A first segment common electrode voltage at first segment 831 of common electrode 820 is modulated to a high voltage 841 to drive rapidly all the pixels to the dark state 843, independent of the voltage on the pixel electrodes. The pixel electrodes for pixels 802, 803, and 815 are then updated to their new voltage levels in the conventional row-at-a-time addressing scheme 831. When all the rows in this segment have been updated the common electrode is set to its next value 842 for image display.

In FIG. 8B this is shown as zero volts, but the value depends on the choice of dc balancing scheme used. Also, for liquid crystal driving, the drive-to-dark pulse is likely to alternate between positive and negative pulses to preserve dc balance. Note that all the pixels are driven to a dark state rapidly and simultaneously, and all the pixels begin their trajectory towards a gray level simultaneously, even though the pixel electrode voltages are updated row-at-a-time.

The above approach is advantageous in a color sequential display. A color illumination source or rapidly switching color filter device can be synchronized to illuminate simultaneously the entire segment with a single color of light without illuminating pixels which are displaying inappropriate data. Furthermore, the time interval during which the entire segment is dark may be used to allow some color generation means, such as a liquid crystal color filter or a color illuminator with a relatively slow color update, to change state without any transient color effects being visible.

The foregoing embodiments are merely exemplary and are not to be construed as limiting the present invention. The present methods can be readily applied to other types of apparatuses. The description of the present invention is intended to be illustrative, and not to limit the scope of the claims. Many alternatives, modifications, and variations will be apparent to those skilled in the art.

What is claimed is:

1. A color sequential display system comprising:

a first substrate having a first plurality of pixel electrodes for receiving a first plurality of pixel data values representing a first image to be displayed;

an electro-optic layer operatively coupled to said pixel electrodes;

a liquid crystal color filter operatively coupled to said electro-optic layer, said liquid crystal color filter having a first color state and a second color state wherein said electro-optic layer is illuminated with a first produced by said liquid crystal color filter in said first color state and said electro-optic layer is illuminated with a second color produced by said liquid crystal color filter in said second color state;

an electrode operatively coupled to said electro-optic layer, said display system displaying said first image while said liquid crystal color filter is in said first color state and then applying a first control voltage to said electrode to alter a state of said electro-optic layer such that said first image is substantially not displayed and then changing said liquid crystal color filter to said second color state and loading a second plurality of pixel data values onto said first plurality of pixel electrodes and then said display system displaying a second image represented by said second plurality of pixel data values after said electrode receives a second control voltage.

2. A color sequential display system as in claim 1 wherein said electro-optic layer comprises a liquid crystal and said electrode comprises a cover glass electrode.

3. A color sequential display system as in claim 2 wherein for at least a set of pixels of said first image, said electro-optic layer has not reached a saturated display level for said set of pixels when said first control voltage is applied to said electrode.

4. A color sequential display system as in claim 2 wherein said second image is displayed during a time when said liquid crystal filter is in said second color state.

5. A color sequential display system as in claim 2 wherein said first control voltage and said second control voltage are set such that said electrode receives an electrode voltage over time which is DC balanced.

6. A color sequential display system as in claim 2 wherein said first image and said second image are independent color subframes of a full color frame.

7. A color sequential display system as in claim 6 wherein said first control voltage drives said electro-optic layer to dark between said independent color subframes.

8. A color sequential display system as in claim 2 wherein at least one of said first control voltage and said second control voltage is approximately equal to a maximum voltage which can be applied to said first plurality of pixel electrodes.

9. A color sequential display system as in claim 7 wherein said first control voltage is applied to said electrode while loading said second plurality of pixel data values and while changing said liquid crystal color filter to said second color state.

10. A method for operating a display system, said display system comprising a first substrate having a plurality of pixel electrodes, an electro-optic layer operatively coupled to said pixel electrodes, a switchable color filter operatively coupled to said electro-optic layer, and an electrode operatively coupled to said electro-optic layer, said method comprising:

applying a first plurality of pixel data values to said plurality of pixel electrodes such that a first pixel data represented by said first plurality of pixel data values is displayed after said switchable color filter is set to a first color state wherein said electro-optic layer is illuminated with a first color produced by said switchable color filter in said first color state;

applying a first control voltage to said electrode to alter a state of said electro-optic layer after applying said first plurality of pixel data values to said plurality of pixel electrodes such that said first pixel data is substantially not displayed;

changing said switchable color filter to a second color state after applying said first control voltage;

applying a second plurality of pixel data values to said plurality of pixel electrodes after applying said first control voltage to said electrode, said second plurality of pixel data values representing a second pixel data;

displaying said second pixel data after said switchable color filter is switched to said second color state.

11. A method as in claim 10 wherein said step of displaying said second pixel data comprises:

applying a second control voltage to said electrode to alter said state of said electro-optic layer such that said second pixel data is displayed, and wherein a first image is represented by said first pixel data and a second image is represented by said second pixel data.

12. A method as in claim 11 wherein said electro-optic layer comprises a liquid crystal and said electrode is a common cover glass electrode and said switchable color filter is a liquid crystal color filter.

13. A method as in claim 11 wherein said second plurality of pixel data values are applied to said plurality of pixel electrodes while said first control voltage is applied to said electrode.

14. A method as in claim 13 wherein said first pixel data and said second pixel data are independent color subframes of a full color frame.

15. A method as in claim 14 wherein said first control voltage drives said electro-optic layer to dark between said independent color subframes.

16. A method as in claim 15 wherein said first control voltage and said second control voltage are set such that said electrode receives an electrode voltage over time which is DC balanced.

* * * * *

UNITED STATES PATENT AND TRADEMARK OFFICE

CERTIFICATE OF CORRECTION

PATENT NO. : 5,920,298

DATED : July 06, 1999

INVENTOR(S) : Douglas McKnight

It is certified that error appears in the above-identified patent and that said Letters Patent is hereby corrected as shown below:

In column 11 at line 67 insert --color-- following "first" and before "produced"

Signed and Sealed this

Twenty-first Day of December, 1999

*Attest:*

Q. TODD DICKINSON

*Attesting Officer*

*Acting Commissioner of Patents and Trademarks*